US008973890B2

(12) United States Patent
Schrobenhauser et al.

(10) Patent No.: US 8,973,890 B2
(45) Date of Patent: Mar. 10, 2015

(54) FLUID-OPERATED ACTUATING DRIVE ON A VALVE

(75) Inventors: Max Schrobenhauser, Peiting (DE); Jochen Schaible, Altensteig (DE); Stephan Schelp, Hohenfurch (DE); Marcus Groedl, Altdorf (DE)

(73) Assignee: Hoerbiger Automatisierungstechnik Holding GmbH, Altenstadt (DE)

( * ) Notice: Subject to any disclaimer, the term of this patent is extended or adjusted under 35 U.S.C. 154(b) by 0 days.

(21) Appl. No.: 13/566,597

(22) Filed: Aug. 3, 2012

(65) Prior Publication Data

US 2013/0009080 A1 Jan. 10, 2013

Related U.S. Application Data

(63) Continuation of application No. PCT/EP2011/000528, filed on Feb. 4, 2011.

(30) Foreign Application Priority Data

Feb. 5, 2010 (DE) ..... 10 2010 007 152

(51) Int. Cl.
*F16K 31/124* (2006.01)
*F15B 9/12* (2006.01)

(52) U.S. Cl.
CPC ..... *F15B 9/12* (2013.01)
USPC ..... 251/29; 251/30.01; 251/31

(58) Field of Classification Search
USPC ..... 251/28, 29, 30.01, 31, 33
See application file for complete search history.

(56) References Cited

U.S. PATENT DOCUMENTS

| | | | | | |
|---|---|---|---|---|---|
| 1,093,161 | A | * | 4/1914 | Wilkinson | 236/24.5 |
| 1,962,676 | A | * | 6/1934 | Albright | 137/11 |
| 2,812,774 | A | * | 11/1957 | Anderson et al. | 137/489 |
| 4,722,360 | A | * | 2/1988 | Odajima et al. | 137/487.5 |
| 4,723,474 | A | * | 2/1988 | Flohr | 91/36 |
| 5,329,956 | A | * | 7/1994 | Marriott et al. | 137/15.01 |
| 5,878,765 | A | | 3/1999 | Lange | |

(Continued)

FOREIGN PATENT DOCUMENTS

| | | | |
|---|---|---|---|
| DE | 922210 | * | 1/1955 |
| DE | 3819122 | A1 * | 12/1989 |

(Continued)

OTHER PUBLICATIONS

English Translation of the International Search Report for corresponding International Application No. PCT/EP2011/000528, with a mail date of May 11, 2011.

*Primary Examiner* — John K Fristoe, Jr.
*Assistant Examiner* — Jonathan Waddy
(74) *Attorney, Agent, or Firm* — Myers Wolin, LLC

(57) ABSTRACT

A fluid-operated actuating drive on a valve comprising a base unit (2) having an electro-fluidic signal converter and a fluidic controller and at least one linear actuator (4) that can be actuated using the fluidic controller, wherein the gate (11) of the linear actuator is directly or indirectly coupled to the inlet of the valve. A control unit (22) is connected to a signal input of the base unit, wherein the signal output is connected to the electro-fluidic signal converter. The actual value signal of a measurement transducer (24) associated to the valve is fed back to the control unit. A fluidic internal control circuit (27) is arranged functionally between the signal input and the at least one linear actuator, preferably downstream of the electro-fluidic signal converter.

15 Claims, 4 Drawing Sheets

(56) References Cited

U.S. PATENT DOCUMENTS

| | | | | |
|---|---|---|---|---|
| 5,884,894 | A * | 3/1999 | Smith | 251/28 |
| 6,155,531 | A * | 12/2000 | Holborow et al. | 251/30.02 |
| 6,776,180 | B1 * | 8/2004 | Yonnet | 137/14 |
| 2004/0113109 | A1 * | 6/2004 | Silva | 251/30.01 |
| 2010/0229975 | A1 * | 9/2010 | Sweeney et al. | 137/556 |
| 2011/0248195 | A1 * | 10/2011 | Fry et al. | 251/28 |
| 2011/0284083 | A1 * | 11/2011 | Tondolo et al. | 137/1 |

FOREIGN PATENT DOCUMENTS

| | | | |
|---|---|---|---|
| DE | 19540441 | * | 4/1997 |
| EP | 0665381 | A1 * | 8/1995 |
| EP | 0884481 | A2 * | 12/1998 |
| EP | 1418343 | A1 * | 5/2004 |
| EP | 1593893 | * | 10/2007 |
| EP | 2101061 | A1 * | 9/2009 |

* cited by examiner

FLUID-OPERATED ACTUATING DRIVE ON A VALVE

CROSS REFERENCE TO RELATED APPLICATIONS

The present application is a continuation of International Application No. PCT/EP2011/000528 filed on Feb. 4, 2011, which claims priority to DE 10 2010 007 152.8 filed on Feb. 5, 2010, the contents of each of which are incorporated herein by reference.

FIELD OF THE INVENTION

The present invention relates to a fluid-operated actuating drive on a valve, especially a shutoff, safety or regulating valve.

BACKGROUND

In practice, various valve actuating drives are known and in use. Besides widely employed electrical valve actuating drives, these also include in particular fluid-operated valve actuating drives (see, for example, EP 0665381 B1, EP 1418343 B1, EP 1593893 B1 and EP 2101061 A1). Typically such fluid-operated valve actuating drives comprise a linear actuator, whose slide is coupled directly or indirectly with the input of the valve, and a base unit provided with the fluidic control system. This latter typically comprises an electrofluidic signal transducer, which in particular is disposed upstream from the fluidic control system and is able to cooperate therewith and may have a proportional output response. Furthermore, at a signal input in communication with the electrofluidic signal transducer or associated therewith, there is typically connected an external electrical regulating unit, which may comprise input means, a setpoint input, a regulating electronic unit, a communications unit, a signal output and/or a signal generator. In the sense of a closed regulating circuit, the actual-value signal of a measuring sensor associated with the valve may then be fed back to the electrical regulating unit.

EP 884481 A2 discloses a pneumatic position regulator for a pneumatic actuating drive, whose manipulated variable is corrected to an adjustable setpoint value, especially for positioning of membrane-actuated and piston-actuated regulating valves in proportion to a pneumatic input signal. In order to avoid pressure losses, this position regulator is equipped with three main components, namely a comparator, which compares the manipulated variable with the setpoint value and outputs a difference value, a first valve, which is disposed in the flow path from a pneumatic pressure source to the actuating drive, is closed in the rest condition and can be activated by the difference value, and a second valve, which is disposed in the flow path from a relief aperture of the actuating drive to a pressure sink, is closed in the rest condition and can be activated by the difference value. The regulating circuit of the position regulator contains a pneumatic actuating drive with a positioning element in the form of an actuating rod, which couples the manipulated variable to the element determining the flow through the valve, slide or the like. The actuating drive is provided with a pressure-urged membrane, with which the positioning element is connected. The stroke movement of the positioning element is output via a mechanism, preferably a cam mechanism with exchangeable cam disks, to the one end of a compression spring, whose other end loads the one arm of a double-armed lever, which is mounted pivotally at its center. A pressure/force transducer containing a membrane urged by a setpoint pressure presses on the same lever arm as the compression spring, but in opposite direction. The force exerted by the compression spring on the lever arm is compared in the capture range of the regulating circuit with the opposing force exerted via the membrane, by the fact that an equilibrium is established between these forces. Together with the compression spring, the pressure/force transducer therefore forms a setpoint/actual value comparator. In this comparator, the compression spring together with the cam mechanism disposed upstream from it forms a displacement/force transducer, which converts the stroke of the positioning element into the actual-value force.

DE 3819122 C2 discloses a method for regulating the position of servo valves with fluid or with regulated actuating drives operated by electric motors, wherein the deviations between the actual and the ideal correlation of reference variable and controlled variable of the servo valve is sensed as a function of the direction of movement in a preliminary test and a correction value formed from this deviation is delivered to the comparator of reference variable and controlled variable on the regulating device. The delivery of the correction value takes place in the form of a change of the signals of reference and/or controlled variable delivered to the comparator. This correction value is delivered to the regulating device in such a way that the deviation of the correlation of reference variable and controlled variable caused by the hysteresis of the system comprising servo valve with regulated actuating drive is compensated.

SUMMARY

The object of the present invention is to provide a fluid-operated valve actuating drive characterized by particularly favorable regulating behavior. In particular, it includes compensating for interfering variables acting on the system especially rapidly and efficiently.

In this sense, the inventive fluid-operated valve actuating drive is characterized in particular by the fact that at least one fluidic internal regulating circuit is disposed between the signal input and the at least one linear actuator, preferably downstream from the electrofluidic signal transducer. In other words, a control chain is not present between the electrofluidic signal transducer and the linear actuator in the inventive fluid-operated valve actuating drive, but instead at least one fluidic internal regulating circuit is integrated or embedded in this region of the system. In this way there is obtained multilayer regulation, meaning regulation that takes place in several levels, of the valve in question, namely by the fact that a second internal regulating circuit acting purely fluidically is provided in a subordinate level inside the conventional regulating circuit controlled via the electrical regulating unit. In this way unexpectedly pronounced advantages are achieved for the regulation behavior, even in several respects. In the first place, it is favorable that the additional fluidic internal regulating circuit can be disposed functionally and systematically close to the valve, so that interfering variables can already be compensated particularly efficiently in this respect. Furthermore, the fluidic regulation, provided according to the present invention, via the fluidic internal regulating circuit, especially downstream from the electrofluidic signal transducer, is systematically superior to an electrical regulating system in terms of regulation dynamics. As a result, the inventive fluid-operated valve actuating drive is clearly superior to the prior art in terms of regulation behavior.

According to a first preferred improvement, the fluidic internal regulating circuit is constructed as a subordinate position-regulating circuit. In this improvement of the inventive actuating drive, especially the position of the slide of the at least one linear actuator is corrected via the fluidic internal regulating circuit. The advantage, already explained hereinabove, of the immediate, direct correction of the linear actuator in reaction to possible interfering variables is particularly pronounced in this case. The self-regulating drive achieved in this way considerably simplifies the regulation of the valve position. And drive-dependent differences such as reaction and dead times are eliminated.

Another preferred improvement of the invention is characterized in that the electrofluidic signal transducer, together with a closed regulating circuit, preferably a pressure or volume-flow regulating circuit, is constructed as a subordinate regulating circuit. This is advantageous especially in such inventive valve actuating drives in which the pressurized-fluid supply is organized not decentrally, in other words close to the valve, but instead centrally.

In this connection, it proves favorable according to another preferred improvement of the invention, when pneumatic auxiliary energy is used and an I/P converter is employed as the electrofluidic signal transducer. This I/P converter is preferably equipped with an internal pressure sensor and an internal pressure-regulating circuit. Instead of controlled signal transmission, a closed electrical pressure-regulating circuit with a self-regulating pressure control element is present in this case. The improved regulating performance achievable in this way leads to optimum process mastery and quality. Furthermore, it is favorable when the I/P converter is operated by particularly energy-efficient and highly dynamic piezo valve technology and/or has no inherent air consumption in the adjusted condition, the pressure-sensor signal is transmitted for external processing to the electrical regulating unit and/or the pneumatic interface between drive and I/P converter conforms with VDI/VDE 3845 for single-acting drives. According to yet another preferred improvement of the invention, it is provided, especially for use of compressible pressurized fluids in pneumatic drives, that the at least one linear actuator is constructed as an actuator urged by fluid on both sides, in which case both working chambers are constantly connected to a pressurized-fluid supply. If both working chambers of the linear actuator urged by fluid on both sides are connected in this sense directly to the pressurized-fluid supply or are urged thereby, and for positioning purposes, in other words to vary the position of the slide of the linear actuator in question, one of the two working chambers is selectively vented, the slide of the linear actuator is clamped with maximum stiffness in every operating situation, thus permitting particularly good regulation capability. Furthermore, it may be ensured with such a construction that ambient air is never aspirated into the linear actuator, whereby the penetration of contaminants into the system is ruled out and the useful life is prolonged. A further advantage of this improvement consists in the inexpensive structure, which can also be mastered very simply, by the fact that the double-acting linear actuator may be regulated with a single electrofluidic signal transducer. Once again, all of the said advantages are of particular practical relevance, especially for pneumatic inventive valve actuating drives.

In an improvement of the fluid-operated valving-unit actuating drive explained in the foregoing, the fluidic internal regulating circuit may comprise in particular a regulating group connected upstream from the linear actuator and having two structural units that can be moved relative to one another and that release or close control apertures, wherein a first structural unit is coupled with a pilot cylinder urged by a control pressure and the second structural unit is coupled with the slide of the linear actuator. This is particularly favorable in turn in the case of the embodiment of the linear actuator as a double-acting linear actuator, in which case the said regulating group then preferably communicates via a respective drain line with the two working chambers connected constantly to a pressurized-fluid supply. A particularly favorable structural improvement is then characterized in that the regulating group is provided with two drain valves, which respectively comprise a valve seat mounted displaceably against a preload inside a housing.

According to another preferred improvement of the invention, it is provided that the valve actuating drive comprises two linear actuators disposed opposite one another and one mechanical converter, which is disposed between the two linear actuators and which couples their slides with one another. This said mechanical converter is able in particular to convert the linear motion of the slides of the two linear actuators into a rotary motion, namely when the valve is provided with a turnable blocking element, whose position can be varied by way of the valve actuating drive. Particularly preferably, this actuating drive is constructed modularly from individual components in the form of the base unit, joined together as a functional unit, the two linear actuators and the mechanical converter, to obtain a compact, closed fluidic drive system provided with only one electrical input and one mechanical take-off means acting on the input of the valve. The joining together of the said components as the compact, closed fluidic drive system may be accomplished in particular by the fact that the two linear actuators are flanged onto the mechanical converter, which in turn is connected via a flanged joint to the base unit. This ensures that—according to a further preferred improvement—all fluid connections between the base unit and the actuators and if necessary the mechanical converter are routed inside the components in question, so that no kind of exposed fluid lines exist. These said fluid connections may be equipped, specifically in the region of the separating planes through which they pass between the said components, with self-closing shutoffs, which prevent the emergence of fluid or the unintended penetration of contaminants along the separating planes, especially when individual components are demounted for the purpose of maintenance. Additional filter elements for the fluid may be provided in the region of these shutoffs, especially integrated therein or respectively joined thereto as a structural unit. All technical viewpoints mentioned in the foregoing and structurally improving the inventive valve actuating drive prove to be particularly advantageous in hydraulic valve actuating drives according to the present invention. They act in particular to the effect that, from the viewpoint of the user of the fluid-operated valve actuating drive, they may be regarded as completely equivalent to the electrical valve actuating drives in terms of maintenance and upkeep, while at the same time preserving the specific advantages of fluid-operated versus electrical valve actuating drives, namely the special compactness, energy efficiency and reliability as well as simple implementation of highly dynamic safety functions if necessary, the latter feature in particular being due to the capability of storing fluidic energy.

It has already been mentioned hereinabove that, within the scope of the present invention, the pressurized-fluid supply may be organized both centrally, in other words commonly for several valve actuating drives, and decentrally, in other words associated respectively with only one individual valve actuating drive. In the latter case, the base unit of the inventive fluid-operated valve actuating drive particularly preferably comprises a pressurized-fluid supply unit. In the case of a hydraulically actuated valve actuating drive according to the present invention, such a pressurized-fluid supply unit particularly preferably comprises a hydraulic assembly fed from a tank and equipped with a pump driven by an electric motor. In contrast, in a pneumatically operated valve actuating drive according to the present invention, the said pressurized-fluid supply unit preferably comprises a pneumatic pump driven by an electric motor and aspirating ambient medium—preferably via a filter system. If the inventive fluid-operated valve actuating drive is constructed in the foregoing sense as a hydraulic actuating drive, it may be provided, according to yet another preferred improvement, with a filling port suitable for the first filling of the fluid system with hydraulic fluid from a cartridge, especially a port disposed on the base unit. This enables the user to place a hydraulically operating valve actuating drive according to the present invention in service without coming into contact in any way with hydraulic fluid. This in turn favors the use of hydraulically operated valve actuating drives, which as regards their operating behavior are superior to electrical valve actuating drives (see hereinabove), even in applications in which special value is placed by the user on cleanness and a minimum risk of coming into contact with hydraulic fluid.

In the sense of high safety against failure of the system, merely one of the possibilities is that, as already mentioned hereinabove, of storing fluid energy in a pressure accumulator (especially externally mounted), in order that the valve can still be brought at least to a predetermined safety position in the event of failure of the pressurized-fluid supply. Alternatively, it is also possible if necessary to integrate a mechanical energy-storing spring in the at least one linear actuator. Particularly preferably, such a mechanical energy-storing spring is preloaded by fluidic pressure and interlocked in the preloaded position, so that it does not constantly urge the slide of the linear actuator in question in the sense that work would have to be done continuously against the force of the mechanical energy-storing spring. In this case the mechanical energy-storing spring urges the slide of the associated linear actuator only after actuation of an interlock release, by means of which a blockade holding the energy-storing spring is cancelled. Such a mechanical energy-storing spring, which is held in blocking condition during normal operation and is released only in an emergency by cancelation of the blockade, combines the advantages of high reliability of the valve actuating drive with further viewpoints, such as economy, compactness and actuation dynamics.

BRIEF DESCRIPTION OF THE FIGURES

Further advantageous improvements of the present invention are specified in the dependent claims or will become apparent from the explanation hereinafter of preferred exemplary embodiments of the present invention.

Herein

DETAILED DESCRIPTION

Figure 1:
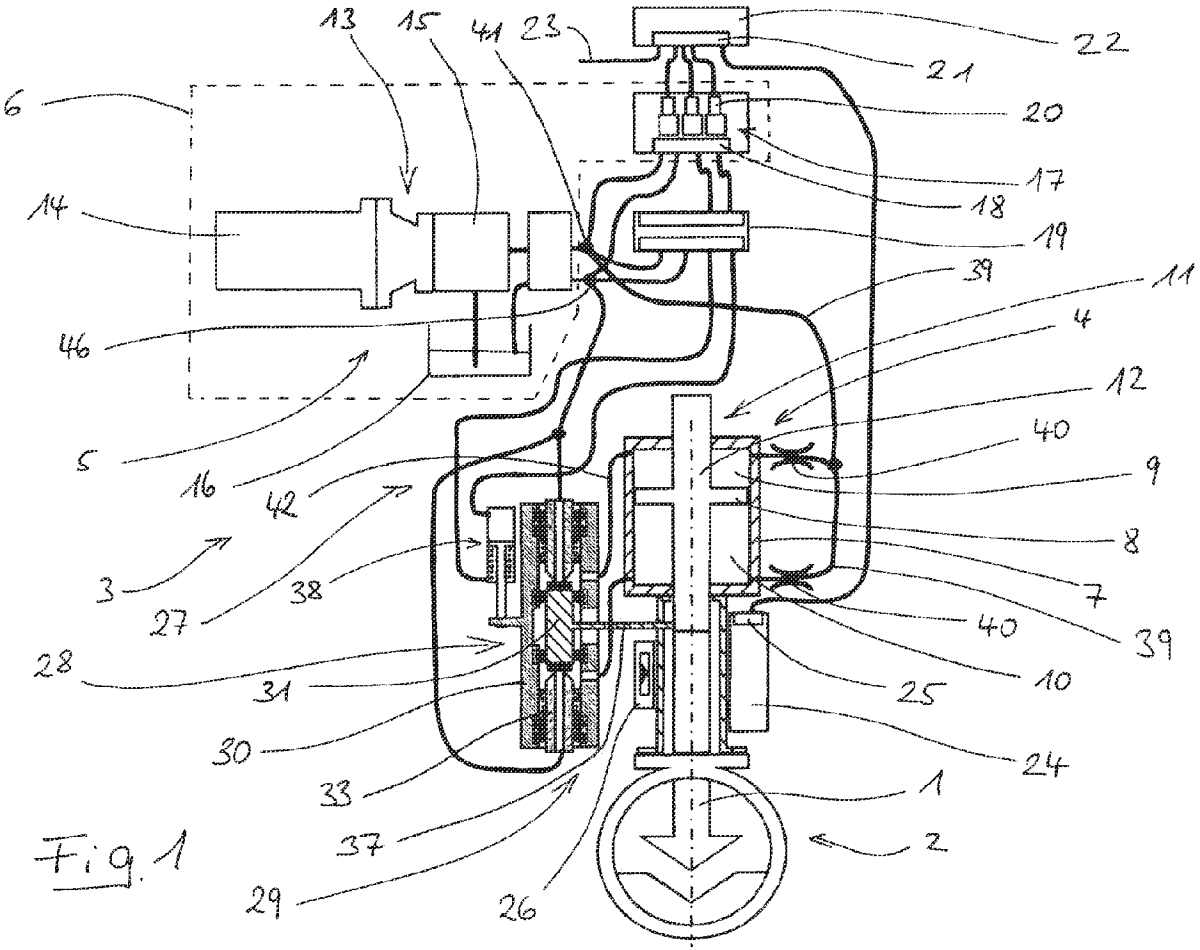
FIG. 1 shows a schematic diagram of a hydraulically operating valve actuating drive according to the present invention.

According to FIG. 1, a hydraulically operating valve actuating drive 3 is associated with a shutoff valve 2, known in itself and comprising a linearly movable shutoff slide 1. This drive comprises as main components a linear actuator 4 and a base unit 6 provided with a pressurized-fluid supply unit 5 and a fluidic control system. This linear actuator 4 is constructed as a double-acting hydraulic cylinder with a piston 8, which is guided in a cylinder 7 and separates two working chambers 9 and 10 urged in opposite directions from one another, and which is connected to a slide 11 in the form of a piston rod 12. This piston rod 12 acts directly on shutoff slide 1 of shutoff valve 2.

In a manner known in itself, pressurized-fluid supply means 5 comprises a hydraulic assembly 13 with a hydraulic pump 15 driven by an electric motor 14 and a tank 16 for the hydraulic fluid. Furthermore, base unit 6 comprises fluidically piloted valves 17 and a fluidic interface 18, via which the base unit is in communication with a downstream fluidic translator 19. Fluidically piloted valves 17 of base unit 6 are activated—via associated signal inputs—by electrofluidic signal transducers in the form of pilot valves 20, on which electrical regulating unit 22 acts, which unit is itself equipped with a communication interface 21. Furthermore, a setpoint input 23—connected to a non-illustrated setpoint feed—is connected via communication interface 21 to regulating unit 22.

Position sensor 24, which is connected via a communication interface 25 to regulating unit 22 and feeds the actual position of shutoff slide 1 back to regulating unit 22, is associated with shutoff slide 1 of shutoff valve 2. Furthermore, an optical position indicator 26 is provided.

Within the scope explained in the foregoing, the valve actuating drive according to FIG. 1 is analogous to the sufficiently known, widely used prior art, and so more detailed explanations are unnecessary. The fundamental deviation of valving-unit actuating drive 3 according to FIG. 1 compared with the prior art consists in the fact that regulating unit 22 does not act directly on linear actuator 4 in such a way that a fluidic internal regulating circuit 27 located downstream from the electrofluidic signal transducer exists functionally between the signal input of base unit 6 and linear actuator 4. Thus fluidic translator 19 is in direct hydraulic communication not with the ports of linear actuator 4 but instead with a purely hydraulic regulating group 29 comprising a self-regulated positioning drive 28.

Self-regulated positioning drive 28 comprises (see FIG. 2) a housing 30 and a slide 31 guided displaceably therein (double arrow A), which slide is sealed relative to housing 30 by means of O-rings 32. Furthermore, two nozzle inserts 33 are accommodated in housing 30. These are also guided displaceably in housing 30, specifically parallel to direction of movement A of slide 31, and are sealed relative to housing 30 by means of O-rings 34. Furthermore, they are preloaded against a stop 36 by means of springs 35. In the neutral position of self-regulated positioning drive 28 illustrated in FIG. 3, these two nozzle inserts bear sealingly against sealing members 49, which are disposed at the end faces on slide 31, in such a way that control apertures of nozzle inserts 33 are closed by the said sealing members 49.

Via a coupling rod 37, which passes through a window 48 in housing 30, slide 31 of self-regulated positioning drive 28 is connected to slide 11 of linear actuator 4, so that it directly follows the movement thereof. Housing 30 of self-regulated positioning drive 28 is displaceable in its own right. Its position is predetermined by a double-acting pilot cylinder 38. Via base unit 6 and fluidic translator 19, pilot cylinder 38 is controlled by regulating unit 22; thus the latter, via pilot cylinder 38, predetermines the position of housing 30 of self-regulated positioning drive 28.

Via high-pressure lines 39 with flow throttles 40, the two working chambers 9 and 10 of linear actuator 4 are constantly connected to high-pressure side 41 of pressurized-fluid supply unit 5, in other words are constantly subjected to the delivery pressure thereof. Furthermore, the two working chambers 9 and 10 of linear actuator 4 are in communication, via respective drain lines 42, with respective inputs 43 in housing 30 of self-regulated positioning drive 28. In this way, in the adjusted condition, the same pressure conditions as in working chambers 9 and 10 of linear actuator 4 prevail in the two pressure chambers 44 of self-regulated positioning drive 28.

If housing 30 of self-regulated positioning drive 28 moves upward in the lifting direction of shutoff slide 1 due to corresponding urging, predetermined by regulating unit 22, of pilot cylinder 38 by base unit 6 and fluidic translator 19, the upper of the two pressure chambers 44 is placed in communication with low-pressure side 46 of pressurized-fluid supply unit 5 through bore 45 of associated nozzle insert 33. The pressure in upper working chamber 9 of linear actuator 4 drops below the pressure prevailing in lower working chamber 10, with the result that slide 11 of linear actuator 4 is lifted in the sense of servo regulation, specifically until the shutoff slide coupled with slide 11 of linear actuator 4 reaches the position in which slide 31 of self-regulated positioning drive 28 coupled therewith again closes both nozzle inserts 33. In this sense regulating group 29 is provided with two drain valves 47, which respectively comprise a valve seat mounted displaceably against a preload inside a housing 30.

In the illustrated system, an interfering variable acting on shutoff slide 1 is directly compensated within the purely hydraulic regulating circuit of self-regulated positioning drive 28, and so to this extent no regulating intervention of regulating unit 22 takes place. The regulation characteristic of regulating unit 22 is matched to this.

Figure 3:
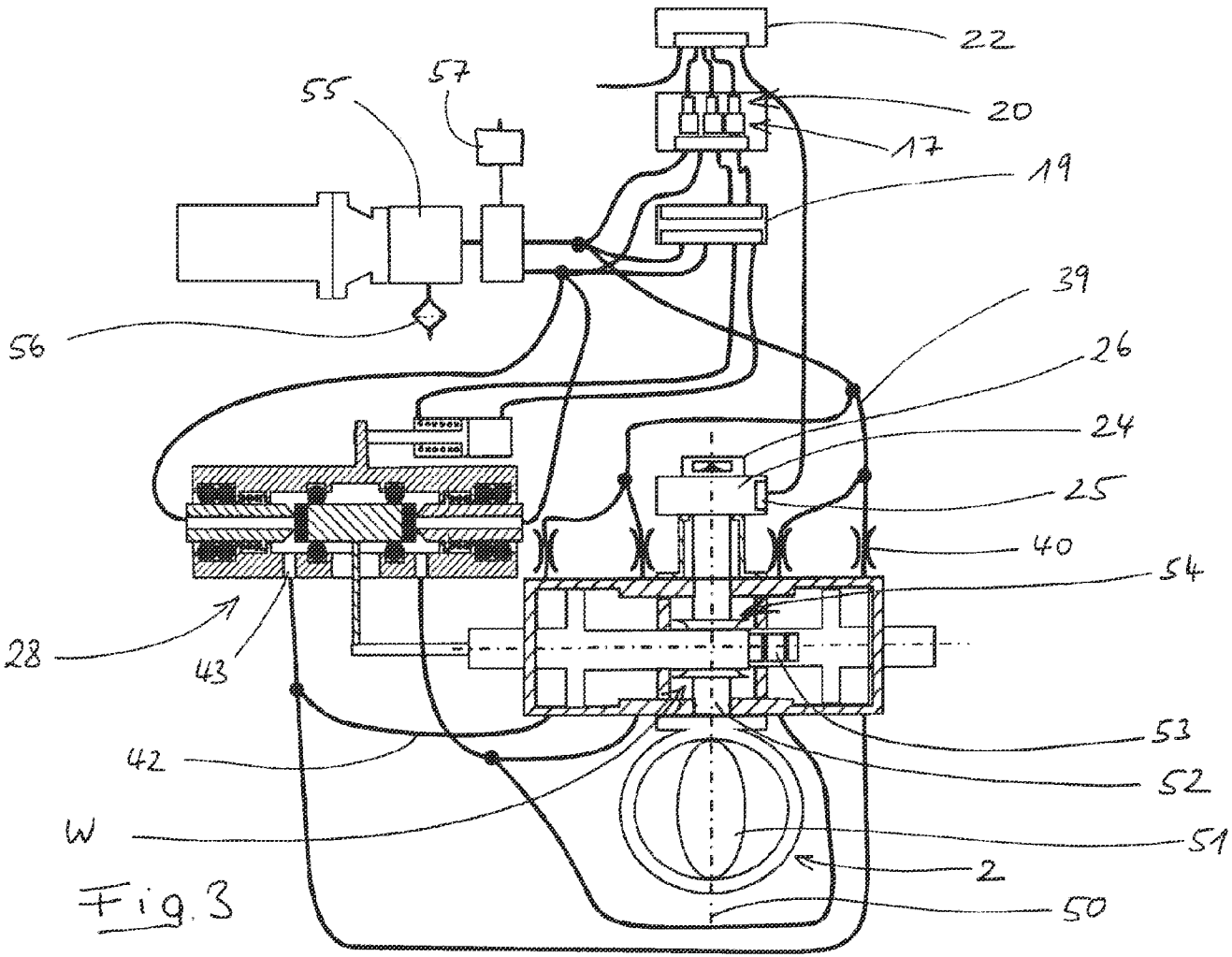
FIG. 3 shows a schematic diagram of a pneumatically operating valve actuating drive according to the present invention.

FIG. 3 illustrates an embodiment which is substantially comparable in terms of its function with the embodiment according to FIG. 1, although the following deviations from the embodiment according to FIG. 1 are to be emphasized.

Thus shutoff valve 2 is provided with a blocking element 51 that can be turned around an axis 50 instead of with a blocking slide. This is connected to rotate with a shaft 52. Furthermore, two counter-running double-acting linear actuators 4 are employed in the embodiment according to FIG. 3. These are connected in antiparallel relationship to the further components of the pneumatic system. Furthermore, the linear motion of the two linear actuators is converted into rotation in a mechanical converter W, wherein the slides of the linear actuators act via toothed racks 53 on a toothed gear 54 connected to rotate with shaft 52.

In addition, the valving-unit actuating drive operates pneumatically. Accordingly, instead of a hydraulic pump, pressurized-fluid supply unit 5 comprises an air compressor 55. This aspirates ambient air via a filter 56. The pneumatic fluid is blown off into the environment on the low-pressure side, for which purpose a muffler 57 is provided there.

Figure 2:
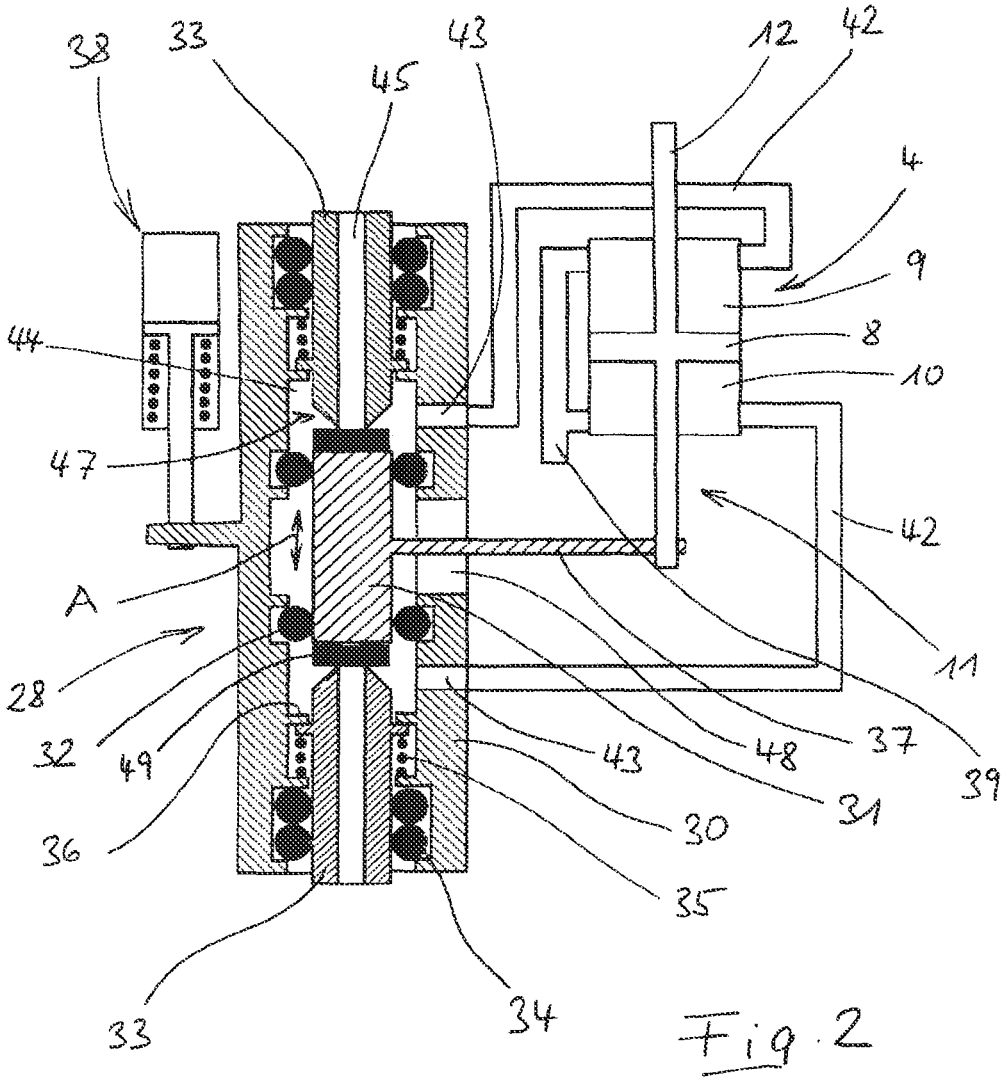
FIG. 2 shows a structural configuration of a self-regulated positioning drive implemented in the valve actuating drive according to FIG. 1.

Otherwise the person skilled in the art will understand the embodiment according to FIG. 3 and the function thereof directly from the foregoing explanations of FIGS. 1 and 2, and so to avoid repetitions these will not be presented here.

Figure 4:
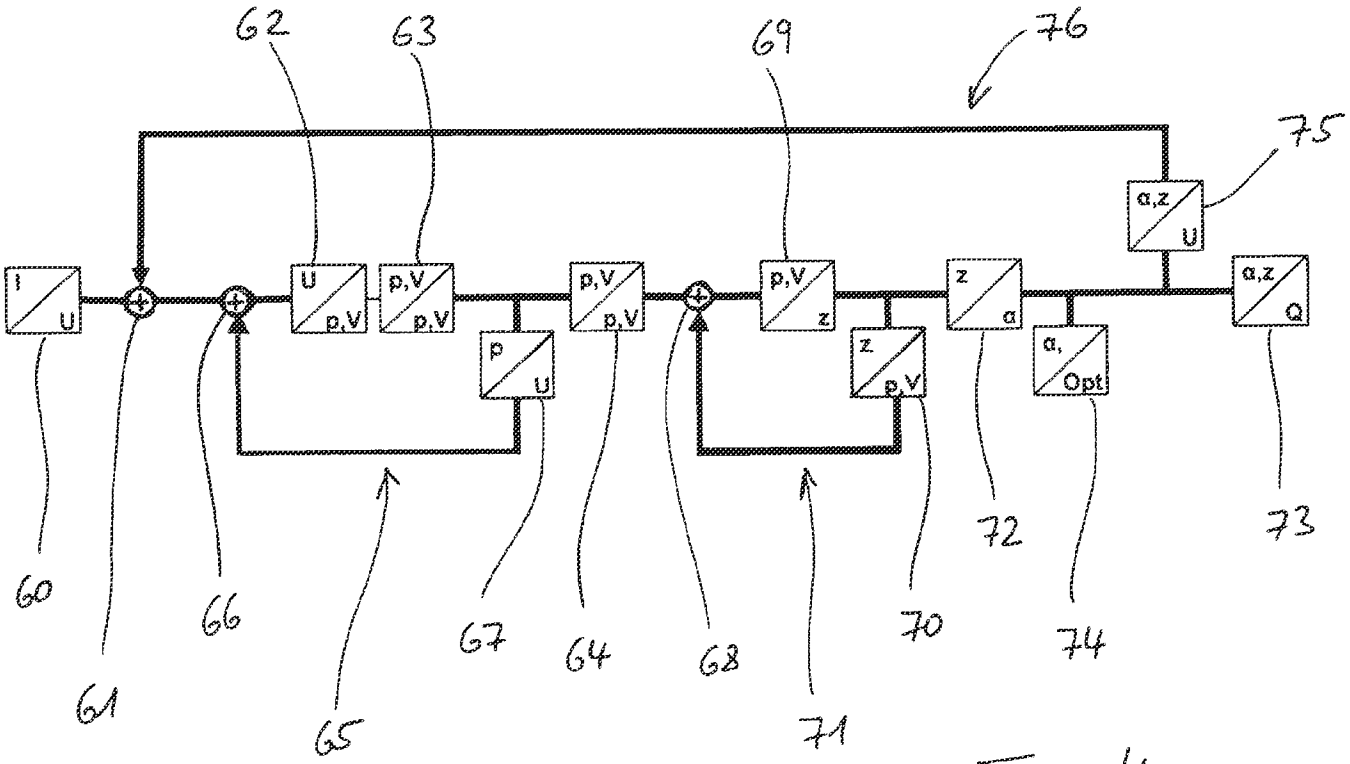
FIG. 4 shows the regulation diagram of the exemplary embodiments of an inventive fluid-operated valve actuating drive shown in FIGS. 1 and 3.

According to the regulation diagram illustrated in FIG. 4, an input signal travels via communication input 60 to position regulator 61 (cf. regulating unit 22). As shown in FIGS. 1 and 3, this is able to act directly on a fluid control element 62 (cf. pilot valves 20), which acts on a fluid translator 63 (cf. hydraulically piloted valves 17), which in turn acts on a further fluid translator 64 (cf. fluidic translator 19). Nevertheless, between position regulator 61 and the further fluid translator 64, as explained in general in the description, it is also possible to integrate a subordinate pressure-regulating circuit 65, which comprises a self-regulating pressure control element and has a pressure regulator 66, to which the signal of a pressure sensor 67 is fed back. The output of further fluid translator 64 acts on position regulator 68 (cf. regulating group 29), which in combination with linear drive 69 (cf. linear actuator 4) and displacement transducer 70 (cf. coupling rod 37) forms a subordinate position-regulating circuit 71 comprising a self-regulating positioning drive. In the embodiment according to FIG. 3, linear drive 69 acts on a rotary transducer 72 (cf. mechanical converter W), whose output acts on valve 73 (cf. shutoff valve 2). The position of rotary transducer 72 may be optically indicated in position indicator 74 (cf. position indicator 26). Furthermore, the actual position of the linear drive (embodiment according to FIG. 1) or of the rotary transducer (embodiment according to FIG. 3) is sensed via a position sensor 75 (cf. position sensor 24) and, for formation of a regulating circuit 76 for valving-unit position, is fed back to position regulator 61.

We claim:

1. A fluid-operated actuating drive on a valve comprising:

a base unit (6) provided with a fluidic control system, upstream from which there is disposed an electrofluidic signal transducer with proportional output response, and at least one linear actuator (4), which can be operated by using the fluidic control system and having a slide (11) that is coupled directly or indirectly with an input of the valve, wherein the base unit comprises:

a signal input of the electrofluidic signal transducer, to which signal input there is connected an external electrical regulating unit comprising:

input means, a setpoint input, a regulating electronic unit, a signal output of the external electrical regulating unit in communication with the signal input of the electrofluidic signal transducer, and a signal generator, to which external electrical regulating unit an actual-value signal of a measuring sensor (24) associated with the valve is fed back, and a fluidic internal regulating circuit (27; 65, 71) functionally disposed between the signal input and the at least one linear actuator downstream from the electrofluidic signal transducer, wherein the at least one linear actuator (4) is constructed as an actuator urged by fluid on both sides, and having two working chambers (9, 10) constantly connected to a pressurized-fluid supply, wherein the fluidic internal regulating circuit (27; 71) comprises a regulating group (29) connected upstream from the linear actuator (4) and having two structural units that can be moved relative to one another and that release or close control apertures, wherein a first structural unit is coupled with a pilot cylinder (38) urged by a control pressure and the second structural unit is coupled with the slide (11) of the linear actuator (4), and wherein the regulating group (29) is provided with two drain valves (47), which respectively comprise a valve seat mounted displaceably against a preload inside a housing (30).

2. The drive according to claim 1, wherein the fluidic internal regulating circuit is constructed as a subordinate positioning regulating circuit (27; 71).

3. The drive according to claim 1, wherein the electrofluidic signal transducer together with a closed regulating circuit, is constructed as a subordinate regulating circuit.

4. The drive according to claim 1, wherein the regulating group (29) communicates via a respective drain line (42) with the two working chambers (9, 10).

5. The drive according to claim 1, further comprising two linear actuators (4) with respective slides disposed opposite one another and one mechanical converter (W) disposed between the two linear actuators and which couples their slides with one another.

6. The drive according to claim 1, further comprising indicator means (26), end switches, end stops, end-position dampers, manual actuating means and/or position sensors (24) in addition to the measuring sensor.

7. The drive according to claim 1, wherein the base unit (6) comprises a pressurized-fluid supply unit (5).

8. The drive according to claim 7, wherein the pressurized-fluid supply unit (5) comprises a hydraulic assembly (13) fed from a tank (16) and equipped with a pump (15) driven by an electric motor (14).

9. The drive according to claim 7, wherein the pressurized-fluid supply unit further comprises a pneumatic compressor (55) driven by an electric motor (14) and aspirating ambient medium.

10. The drive according to claim 1, further comprising a filling port suitable for the first filling of the fluid system with hydraulic fluid from a cartridge.

11. The drive according to claim 1, wherein pneumatic auxiliary energy is used and an I/P (current to pressure) converter is employed as the electrofluidic signal transducer (20).

12. The drive according to claim 11, where the I/P converter is equipped with an internal pressure sensor (67) and an internal pressure-regulating circuit (65).

13. The drive according to claim 12, wherein the I/P converter has no inherent air consumption in the regulated condition.

14. The drive according to claim 12, wherein the pressure-sensor signal is transmitted for external processing to the electrical regulating unit.

15. The drive according to claim 11, wherein the I/P converter is operated by particularly energy-efficient and highly dynamic piezo valve technology.

* * * * *